US006540101B1

(12) United States Patent
Kim

(10) Patent No.: US 6,540,101 B1
(45) Date of Patent: Apr. 1, 2003

(54) TABLET DISPENSING AND PACKAGING SYSTEM

(76) Inventor: Jun H. Kim, 100-23, Galsandong, Dalsuhgu, Taegu (KR)

( * ) Notice: Subject to any disclaimer, the term of this patent is extended or adjusted under 35 U.S.C. 154(b) by 0 days.

(21) Appl. No.: 09/975,432

(22) Filed: Oct. 10, 2001

(51) Int. Cl.[7] ..... G07F 11/66
(52) U.S. Cl. ..... 221/25; 53/374.4
(58) Field of Search ..... 221/7, 13, 9, 25, 221/26, 302; 53/374.4, 133.8, 155, 168; 83/483, 488, 614

(56) References Cited

U.S. PATENT DOCUMENTS 6,089,136 A * 7/2000 Hinojosa et al. ..... 83/453
6,164,038 A * 12/2000 Kim ..... 53/374.4

* cited by examiner

*Primary Examiner*—Kenneth W. Noland
(74) *Attorney, Agent, or Firm*—John K. Park; Park & Sutton LLP

(57) ABSTRACT

A tablet dispensing and packaging system comprises a safety cutter having a cam disk, a cam shaft eccentric to the disk, an upper support rod, upper and lower blades each having a cutting edge. The lower rod rear end is rotatably carried on the cam shaft, the upper rod has a substantially elongated through-opening near the rear end thereof. A protrusion extends from the upper rod rear end. The through-opening is worn on the cam shaft over the lower support rod, wherein the upper blade rear end is rotatably engaged to the upper rod front end. A pin pivotably carries thereon the lower blade rear end and mid rear portion adjacent to its rear end into a frame. An elastic member elastically administers the cam shaft and the rear end protrusion of the upper support rod.

14 Claims, 3 Drawing Sheets

TABLET DISPENSING AND PACKAGING SYSTEM

BACKGROUND OF THE INVENTION

The invention relates to a pharmaceutical tablet dispensing system. More particularly, the present invention relates to a tablet dispensing and packaging system that efficiently prevents a tablet bag cutter from incurring a possible damage on the system operator.

An automatic tablet dispensing and packaging system is generally provided with a tablet packaging portion and a tablet dropping portion placed above the packaging portion. The table dropping portion includes tablet cassettes each storing therein and dropping therefrom a predetermined set of tablets. The tablet packaging portion includes heating rollers to seal tablets into a series of paper bags using a packaging paper.

A demand in the market is to include in the tablet packaging portion a cutter that performs a safety cutting of the series of tablet-sealed paper bags as well as a batch-unit cutting to improve product reliability. Also, under such a safety cutting application, there should be followed a mechanism that efficiently protects those in charge of system maintenance from safety accidents.

SUMMARY OF THE INVENTION

Accordingly, it is an object of the present invention to provide a tablet dispensing and packaging system that incorporates a substantially improved safety environment in a tablet packaging and cutting mechanism of the system.

Another object is to substantially improve product reliability by efficiently preventing safety accidents from occurring in relation to tablet packaging, cutting and replacement of a tablet packaging paper.

To achieve the above-described objects, a tablet dispensing and packaging system according to the present invention comprises a tablet dropping unit having a hopper therebelow. A pair of heating rollers is provided to consecutively seal tablets from the hopper into a series of tablet bags using a packaging paper. The sealed tablet bags are partitioned one from another by a sealing belt perpendicular to an axis of said each heating roller. Here, the sealing belt has a median to visualize the partitioning of the sealed tablet bags.

The system further includes a safety cutter unit having a cam disk, a cam shaft eccentrically attached to the cam disk, an upper support rod, an upper blade having an upper cutting edge, a lower support rod, and a lower blade having a lower cutting edge. Each rod and blade have a front end and a rear end, wherein the rear end of the lower support rod is rotatably carried on the cam shaft, and the upper support rod has a substantially elongated through-opening adjacent to the rear end thereof.

A protrusion is extended from the rear end of the upper support rod, and the through-opening of the upper support rod is worn on the cam shaft over the lower support rod. The rear end of the upper blade is rotatably engaged to the front end of the upper support rod, wherein a fixture pin pivotably carries thereon the rear end of the lower blade and a mid rear portion adjacent to the rear end of the upper blade into a frame of the system. A mid rear portion adjacent to the rear end of the lower blade is rotatably engaged to the front end of the lower support rod.

For a preferred version, an elastic member is provided to elastically administer the cam shaft and the rear end protrusion of the upper support rod, so that the cam shaft enables the upper and lower support rods to proceed the reciprocal advance and retreat, in accordance with the cam disk rotation and the elastic member administration. Consequently, the cutting edges of the blades pivotably engaged by the fixture pin to the roller frame selectively sever a sealing belt median of the sealed tablet bags by synchronously crossing over and merging into each other.

The elastic member may be a tension spring hooked by the cam shaft and the protrusion of the upper support rod. A shear stress of the upper and lower blades may be substantially determined by a tension of the tension spring. Alternately, the elastic member is formed in a pair of tension springs each hooked by the cam shaft and the protrusion of the upper support rod.

In an embodiment, an automatic safety cutter system may be separately proved with the cam disk, cam shaft, upper and lower support rods, upper and lower blades.

The advantages of the present invention are numerous in that: (1) the tablet dispensing and packaging system according to the present invention efficiently protects an operator in charge of system maintenance from safety accidents related to tablet packaging, paper bag cutting and paper replacement by providing the safety cutting mechanism; (2) the safety cutting mechanism utilizes a correlation between a shear stress serving to sever paper bags and a spring tension determining the shear stress, thereby enabling a system operator to easily construct and adjust the safety cutting factors such as spring tensions and each length of the support rods; and (3) any alien substance such as a human finger, even if it requires a slightly stronger shear stress than the tablet packaging paper to get cut, instantly instigates the elastic member which then releases as much and subsequently keeps the blades open, thereby substantially improving product reliability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
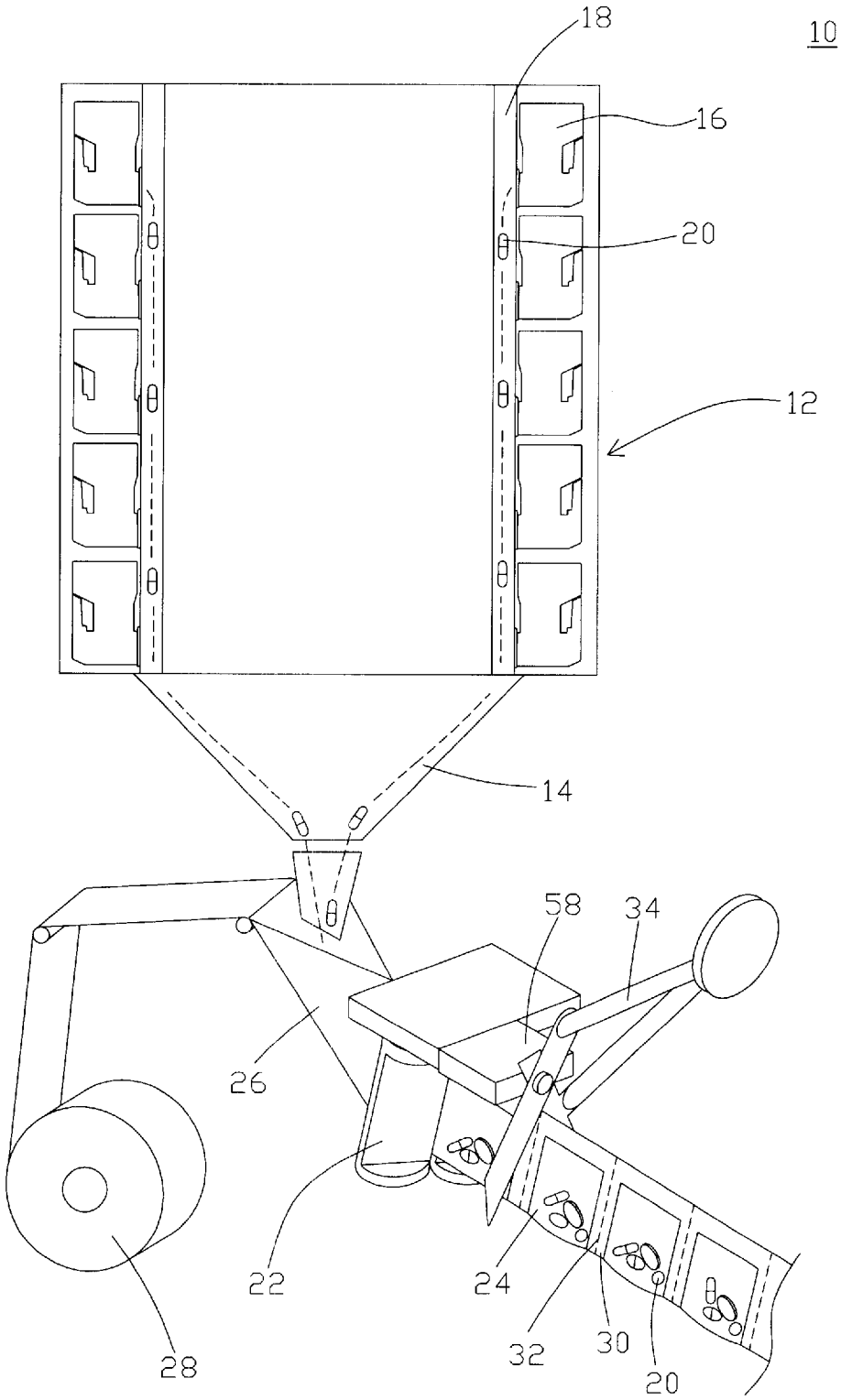
FIG. 1 is a schematic view showing a paper cutting operation in a tablet dispensing and packaging system according to the present invention.

As shown in FIG. 1, the tablet dispensing and packaging system 10 according to the present invention includes a tablet dropping unit 12 having a hopper 14 therebelow. A plurality of tablet cassettes 16 are installed in the tablet dropping unit 12. The tablet cassettes 16 are open to tablet channels 18 through which tablets 20 are dropped from each tablet cassette 16 down to the hopper 14.

The tablet dispensing and packaging system 10 further includes a pair of heating rollers 22 to consecutively seal tablets 20 from the hopper 14 into a series of tablet bags 24 using a packaging paper 26. The packaging paper 26 may be sequentially unrolled from a paper roller 28. Specifically, as the rollers 22 rotate in engagement with each other, the packaging paper 26 is pulled in between the heating rollers 22 and sealed at the same time. Namely, the tablets 20 are dropped from the hopper 14 into the tablet paper 26 and sealed by the combination engagement rolling of the rollers 22 into a series of paper bags 24.

The sealed tablet bags 24 are partitioned one from another by a sealing belt 30 which is perpendicular to an axis of each heating roller 22. The sealing belt 30 has a median 32 to visualize the partitioning of the sealed tablet bags 24. Preferably, each median 32 of the sealing belts 30 are perforated to facilitate the rip-off of one bag from another for the sake of patient's convenience. So each median 32 may equal a perforated line. In a preferred version, the perforation along the median 32 is performed by the heating rollers 22.

Meanwhile, the system 10 is controllably programmed to provide each patient with a predetermined amount of paper-packaged dosage. Each single dosage that can be, for example, nine doses (tablet bags) for three day dosage to a patient, should be separated from another. To that purpose, the series of sealed tablet bags connected to each other may be either manually cut off in a conventional manner or automatically severed according to a programmed demand at a prescription data entry stage.

In order to facilitate partitioning of the sealed tablet bags while virtually preventing safety accidents inevitably involved in each occasion of paper replacement, system error and others, the tablet dispensing and packaging system 10 further provides a safety cutting unit 34.

Figure 2:
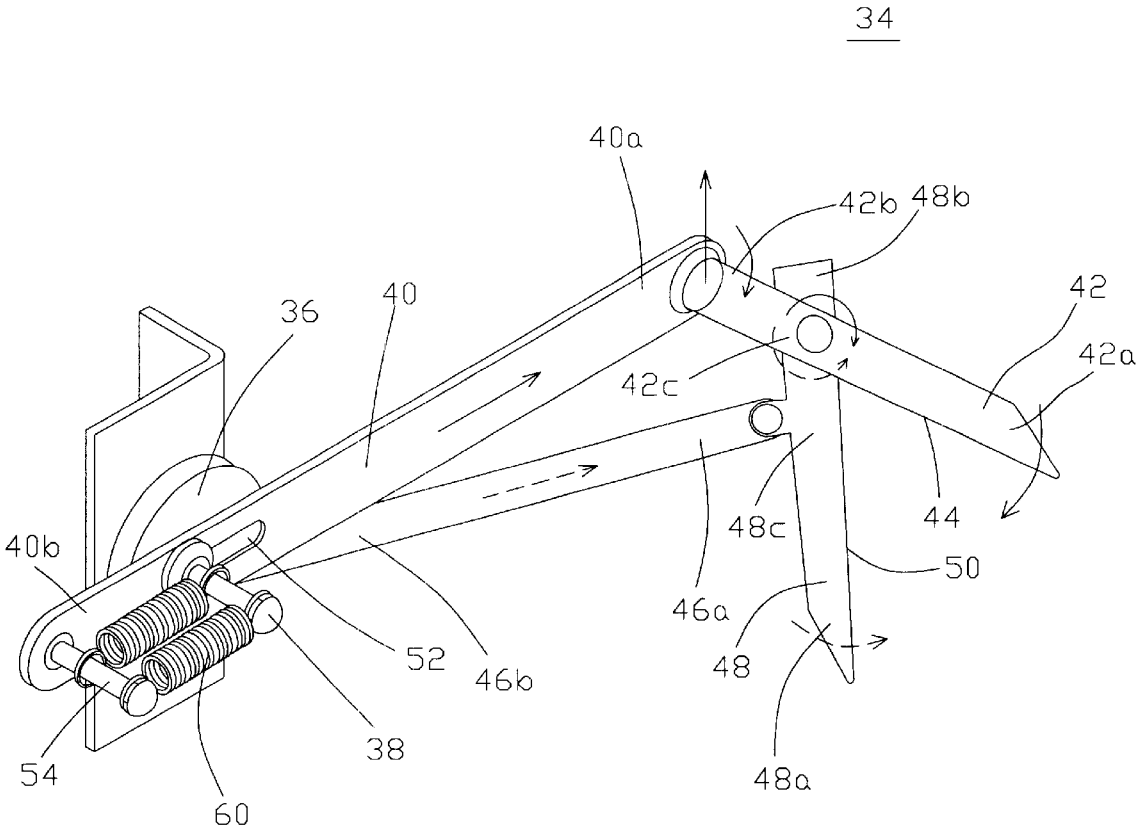
FIG. 2 is a perspective view showing a safety cutter unit according to the present invention.

As further shown in FIG. 2, the safety cutter unit 34 includes a cam disk 36, a cam shaft 38 eccentrically attached to the cam disk 36, an upper support rod 40, an upper blade 42 having an upper cutting edge 44, a lower support rod 46, and a lower blade 48 having a lower cutting edge 50. Each rod and blade 40, 42, 46, 48 has a front end 40*a*, 42*a*, 46*a*, 48*a* and a rear end 40*b*, 42*b*, 46*b*, 48*b*.

In this construction, the rear end 46*b* of the lower support rod 46 is rotatably carried on the cam shaft 38. Also, the upper support rod 40 has a substantially elongated through-opening 52 adjacent to the rear end 40*b* thereof. A protrusion 54 is extended from the rear end 40*b* of the upper support rod 40. The through-opening 52 of the upper support rod 40 is worn on the cam shaft 38 over the lower support rod 46.

The rear end 42*b* of the upper blade 42 is rotatably engaged to the front end 40*a* of the upper support rod 40. A fixture pin 56 pivotably carries thereon the rear end 48*b* of the lower blade 48 and a mid rear portion 42*c* adjacent to the rear end 42*b* of the upper blade 42 into a frame 58 of the system 10 as shown back in FIG. 1. The frame 58 of the system 10 may be either a roller frame supporting the heating rollers 22 or a cam frame supporting the cam disk 36.

Also, a mid rear portion 48*c* adjacent to the rear end 48*a* of the lower blade 48 is rotatably engaged to the front end 46*a* of the lower support rod 46. Further provided is an elastic member 60 to elastically administer the cam shaft 38 and the rear end protrusion 54 of the upper support rod 40 so that the cam shaft 38 enables the upper and lower support rods 40, 46 to proceed the reciprocal advance and retreat, in accordance with the cam disk rotation and the elastic member administration. Consequently, the cutting edges 44, 50 of the blades 42, 48 which are pivotably engaged by the fixture pin 56 to the frame 58 selectively serve to sever a sealing belt median 32 of the sealed tablet bags 24 by synchronously crossing over and merging into each other.

The elastic member 60 may be either one or pair of tension springs hooked by the cam shaft 38 and the protrusion 54 of the upper support rod 40. For a better performance, a shear stress of the upper and lower blades 42, 48 is substantially determined either by a tension of the tension spring 60 or by an aggregated tension of the tension springs 60.

In a preferred embodiment, the safety cutter unit 34 is an independent automatic safety cutter that is applicable to a variety of paper cutting systems other than one specified above. Either system according to the present invention requires the fixture pin 56 rotatably fixed to a frame body, the through opening 52 worn on the cam shaft 38 eccentrically attached to the cam disk 36, and the elastic member 60.

Figure 3:
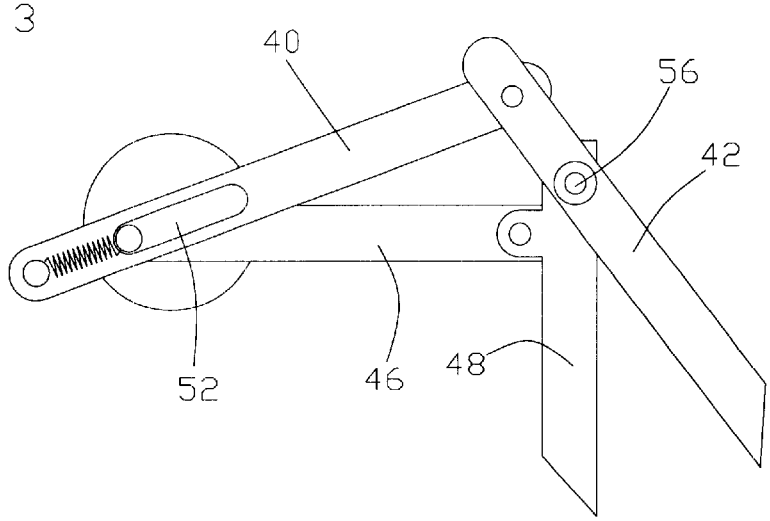
FIG. 3 is a schematic view showing a blade-opened status of the safety cutter unit according to the present invention.
Figure 4:
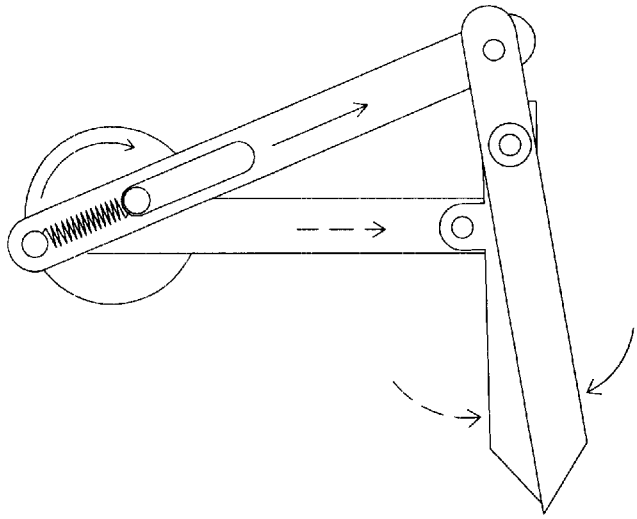
FIG. 4 is a schematic view showing a blade-closed status of the safety cutter unit according to the present invention through which the paper bag cutting is implemented.
Figure 5:
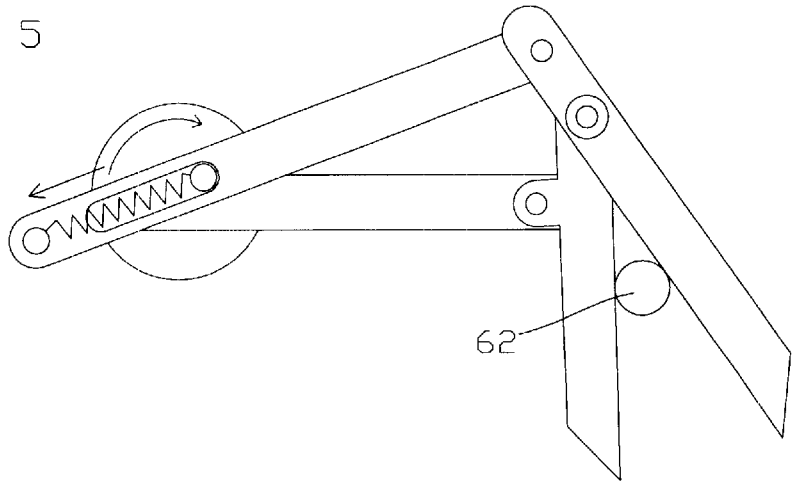
FIG. 5 is a schematic view showing a status of the safety cutter unit where an alien substance is caught between the blades.

With reference to FIGS. 3, 4 and 5, the operation of the safety cutter unit 34 in accordance with a programmed command will now further described. FIG. 3 shows the safety cutter unit 34 in a blade-opened status. In order for the blade-opened status or paper bag holding statue in FIG. 3 to shift to the blade-closed status or paper cutting statue in FIG. 4, the cam shaft 36 is driven by a motor (not shown) in connection with rotation of the heating rollers 22 such that each rotation lap of the heating rollers 22 preferably generates two sealed tablet bags 24.

For example, when a six-dose prescription information for a patient is entered in the system 10, the heating rollers 22 make three laps of rotation and release six packs of sealed tablet bags which are connected to one another by the medians 32 or perforation lines. Then, the safety cutter unit 34 needs to cut off the six tablet packs 24 along an innermost perforation line 32.

To proceed the tablet bag cutting operation in a secured safety, the cam disk 36 driven by the motor (not shown) provides an eccentric rotation to the cam shaft 38. When a selected median 32 of the regular tablet paper bags 24 is positioned between the cutting edges 44, 50 of the blades 42, 48 and the cam shaft 38 rotates by half, the upper and lower support rods 40, 46 proceed. Accordingly, the upper blade rear end 42*b* rotatably engaged to the upper rod front end 40*a* makes as much an clockwise angular rotation and at the same time the upper blade front end 42*a* also makes as much an angular rotation with the fixture pin 56 reserved as a rotational center. On the other hand, the lower blade front end 48*a* makes as much a counterclockwise angular rotation also with the fixture pin 56 reserved as a rotational center, in accordance with the retreat of the lower rod front end 46*a* that is rotatably engaged to the mid rear portion 48*c* adjacent to the fixture pin 56, whereby the paper bag 24 placed between the cutting edges 42, 50 of the blades 42, 48 becomes cut off along its selected median 32.

Here, the paper cutting is implemented because the tension of the elastic member 60 is set to exceed the resistance of the paper bag 24 between the cutting edges 44, 50 against the shear stress of the blades 42, 50. That is, when the paper bag resistance against the cutting edges 44, 50 is surpassed by the tension of the elastic member 60, the cam shaft 38 remains to the left in the through-opening 52 because of the elastic member 60 whose tension exceeds the paper bag resistance against the shear stress of the blades 42, 48. In this mechanism, although the shear stress and tension of the elastic member 60 are hard to measure due to many elements therebetween, the fixed hardness of the paper bags 24 allows a relatively easy adjustment of the tension of the elastic member 60.

As shown in FIG. 5, when an alien substance 62 larger than the paper bags 24 in material hardness, such as a finger of a system operator, is placed between the cutting edges 44, 50 of the blades 42, 48, since the material resistance of the alien substance 62 against the cutting edges 44, 50 exceeds the elastic member tension adjusted in conjunction to the tablet paper bags 24, the elastic member 60 becomes released and the cam shaft 38 stays to the right of the through-opening 52 even in case in which the cam shaft 38 is displaced to the frontmost toward the upper rod front end 40*a*. Therefore, the upper blade 42 stands still without generating a sensible amount of angular rotation of the upper blade 42, thereby efficiently preventing a possible damage to the alien substance such as a human finger between the cutting edges 44, 50 of the blades 42, 48.

An advantage of the present invention is that tablet dispensing and packaging system 10 efficiently protects an operator in charge of system maintenance from safety accidents related to tablet packaging, paper bag cutting and paper replacement by providing the safety cutting mechanism under which the elastic tension is compared to the resistance against shear stress. Further, the safety cutting mechanism of the safety cutter unit 34 utilizes a correlation between a shear stress serving to sever paper bags and a spring tension determining the shear stress, thereby enabling a system operator to easily construct and adjust the safety cutting factors such as spring tensions and each length of the support rods.

In addition, the present invention enables any alien substance such as a human finger, even if it requires a slightly stronger shear stress than the tablet packaging paper to get cut, to instantly instigate the elastic member which then releases as much and subsequently keeps the blades open, thereby substantially improving product reliability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A tablet dispensing and packaging system, comprising:

a) a tablet dropping unit having a hopper therebelow;

b) a pair of heating rollers to consecutively seal tablets from the hopper into a series of tablet bags using a packaging paper, wherein the sealed tablet bags are partitioned one from another by a sealing belt perpendicular to an axis of said each heating roller, wherein the sealing belt has a median to visualize the partitioning of the sealed tablet bags;

c) a safety cutter unit having a cam disk, a cam shaft eccentrically attached to the cam disk, an upper support rod, an upper blade having an upper cutting edge, a lower support rod, and a lower blade having a lower cutting edge, wherein said each rod and blade have a front end and a rear end, wherein the rear end of the lower support rod is rotatably carried on the cam shaft, wherein the upper support rod has a substantially elongated through-opening adjacent to the rear end thereof, wherein a protrusion is extended from the rear end of the upper support rod, wherein the through-opening of the upper support rod is worn on the cam shaft over the lower support rod, wherein the rear end of the upper blade is rotatably engaged to the front end of the upper support rod, wherein a fixture pin pivotably carries thereon the rear end of the lower blade and a mid rear portion adjacent to the rear end of the upper blade into a frame of the system, wherein a mid rear portion adjacent to the rear end of the lower blade is rotatably engaged to the front end of the lower support rod, wherein an elastic member is provided to elastically administer the cam shaft and the rear end protrusion of the upper support rod, whereby the cam shaft enables the upper and lower support rods to proceed the reciprocal advance and retreat, in accordance with the cam disk rotation and the elastic member administration, whereby the cutting edges of the blades pivotably engaged by the fixture pin to the frame selectively sever a sealing belt median of the sealed tablet bags by synchronously crossing over and merging into each other.

2. The system of claim 1 wherein the elastic member is a tension spring hooked by the cam shaft and the protrusion of the upper support rod.

3. The system of claim 2 wherein a shear stress of the upper and lower blades is substantially determined by a tension of the tension spring.

4. The system of claim 1 wherein the elastic member is a pair of tension springs each hooked by the cam shaft and the protrusion of the upper support rod.

5. The system of claim 4 wherein a shear stress of the upper and lower blades is substantially determined by an aggregated tension of the tension springs.

6. The system of claim 1 wherein the median of said each sealing belt is a perforated line.

7. The system of claim 6 wherein the selective severing of the sealed tablet bags is performed along the perforated line.

8. The system of claim 1 wherein the frame of the system is a roller frame supporting the heating rollers.

9. An automatic safety cutter system, comprising:

a) a cam disk;

b) a cam shaft eccentrically attached to the cam disk;

c) upper and lower support rods each having a front end and a rear end, wherein the rear end of the lower support rod is rotatably carried on the cam shaft, wherein the upper support rod has a substantially elongated through-opening adjacent to the rear end thereof, wherein a protrusion is extended from the rear end of the upper support rod, wherein the through-opening of the upper support rod is worn on the cam shaft over the lower support rod;

d) upper and lower blades each having a front end, a rear end, and a cutting edge, wherein the rear end of the upper blade is rotatably engaged to the front end of the upper support rod, wherein a fixture pin pivotably carries thereon the rear end of the lower blade and a mid rear portion adjacent to the rear end of the upper blade into a frame of the system, wherein a mid rear portion adjacent to the rear end of the lower blade is rotatably engaged to the front end of the lower support rod, wherein an elastic member is provided to elastically administer the cam shaft and the rear end protrusion of the upper support rod, whereby the cam shaft enables the upper and lower support rods to proceed the reciprocal advance and retreat, in accordance with the cam disk rotation and the elastic member administration, whereby the cutting edges of the blades pivotably engaged by the fixture pin to the frame selectively sever a series of partitioned paper bags by synchronously crossing over and merging into each other.

10. The system of claim 9 wherein the elastic member is a tension spring hooked by the cam shaft and the protrusion of the upper support rod.

11. The system of claim 10 wherein a shear stress of the upper and lower blades is substantially determined by a tension of the tension spring.

12. The system of claim 9 wherein the elastic member is a pair of tension springs each hooked by the cam shaft and the protrusion of the upper support rod.

13. The system of claim 12 wherein a shear stress of the upper and lower blades is substantially determined by an aggregated tension of the tension springs.

14. The system of claim 9 wherein the frame of the system is a cam frame supporting the cam disk.

* * * * *